United States Patent [19]

Onoda et al.

[11] Patent Number: 4,910,551

[45] Date of Patent: Mar. 20, 1990

[54] PORTABLE IMAGE FORMING APPARATUS

[75] Inventors: Shigeyoshi Onoda, Yokohama; Morikazu Mizutani, Tokyo; Shinji Kanemitsu, Ichikawa; Isao Ikemoto, Kawasaki; Hajime Kitajima, Yokohama, all of Japan

[73] Assignee: Canon Kabushiki Kaisha, Tokyo, Japan

[21] Appl. No.: 325,053

[22] Filed: Mar. 16, 1989

Related U.S. Application Data

[63] Continuation of Ser. No. 243,233, Sep. 7, 1988, which is a continuation of Ser. No. 912,497, Sep. 29, 1986, abandoned.

[30] Foreign Application Priority Data

Sep. 30, 1985 [JP] Japan ..... 60-218435
Sep. 30, 1985 [JP] Japan ..... 60-218436

[51] Int. Cl.[4] ..... G03G 15/00
[52] U.S. Cl. ..... 355/200; 355/21; 355/203
[58] Field of Search ..... 355/21, 200, 203

[56] References Cited

U.S. PATENT DOCUMENTS

| | | | |
|---|---|---|---|
| 4,465,359 | 8/1984 | Nakahata | 355/3 R |
| 4,609,281 | 9/1986 | Miyai et al. | 355/3 R |
| 4,635,010 | 1/1987 | Miyai et al. | 355/21 X |
| 4,684,235 | 8/1987 | Kohmoto et al. | 355/3 R |
| 4,692,018 | 9/1987 | Tamura | 355/21 X |

FOREIGN PATENT DOCUMENTS

| | | |
|---|---|---|
| 56-201261 | 12/1982 | Japan . |
| 61-97662 | 5/1986 | Japan . |
| 1308631 | 2/1973 | United Kingdom . |

OTHER PUBLICATIONS

IBM Technical Disclosure Bulletin, vol. 21, No. 4, Sep. 1978, pp. 1345–1346.

*Primary Examiner*—A. C. Prescott
*Attorney, Agent, or Firm*—Fitzpatrick, Cella, Harper & Scinto

[57] ABSTRACT

An image forming apparatus with a position detection capability to prevent an image forming operation starting signal being generated by mistake to thereby start the image forming operation when an image forming apparatus is not in its normal installed state for use, for example, when the apparatus is in its carried state or its erected state with one side thereof facing downward.

18 Claims, 12 Drawing Sheets

PORTABLE IMAGE FORMING APPARATUS

This application is a continuation of application Ser. No. 243,233 filed Sept. 7, 1988, which was a continuation of Ser. No. 912,497 filed Sept. 29, 1986, now abandoned.

BACKGROUND OF THE INVENTION

1. Field of the Invention

This invention relates to an image forming apparatus such as a copying machine or a printer, and in particular to an image forming apparatus which can be carried and whose body can be erected.

2. Related Background Art

In recent years, along with the advance of the image recording technique and the progress of parts and elements, compactness and light weight of image forming apparatuses such as copying machines has been expedited without their performance being harmed. In such tendency toward compactness, apparatuses which are provided with a handle and can be carried to and used at desired locations in a posture different from that during their operation have been proposed, and during their non-use, the apparatuses can be placed in a vertically upright posture unlike during their operation with the handle positioned above and can be preserved in a narrow space.

Now, in the above-described compact apparatuses, when the apparatus is carried or preserved in a posture different from that during its operation, if the operating button or the like is depressed by mistake while the apparatus remains connected to the power source, the apparatus may start its operation and the original carriage may begin to move or the optical system in the apparatus may start to move and at the same time, the photosensitive drum and process means around it may be operated. The various parts of the apparatus are operated under such situation in which vibration or shock may readily be applied to the apparatus causing it to be easily damaged.

As a technique which copies with such a situation, there can be mentioned U.S. Pat. No. 4,465,359 issued to the same assignee as that of the present application. The apparatus of this patent is such that during the carriage of the apparatus, the original carriage of the movable type is locked to prevent movement of at least the original carriage. However, this technique intends to forcibly block the movement of the original carriage and therefore, an inconvenience that a great load might occur between the original carriage and the driving means therefore could take place in some cases.

SUMMARY OF THE INVENTION

The present invention has been made to solve the above-noted problem and has the following construction. That is, the present invention consists in an image forming apparatus having conveying means for conveying sheet materials, image forming means for forming images on the sheet materials conveyed by said conveying means, and control means for controlling said apparatus so that an image forming operation starting signal is not provided to said image forming means when said apparatus is in its carried state or its erected state.

DESCRIPTION OF THE PREFERRED EMBODIMENTS

Figure 1:
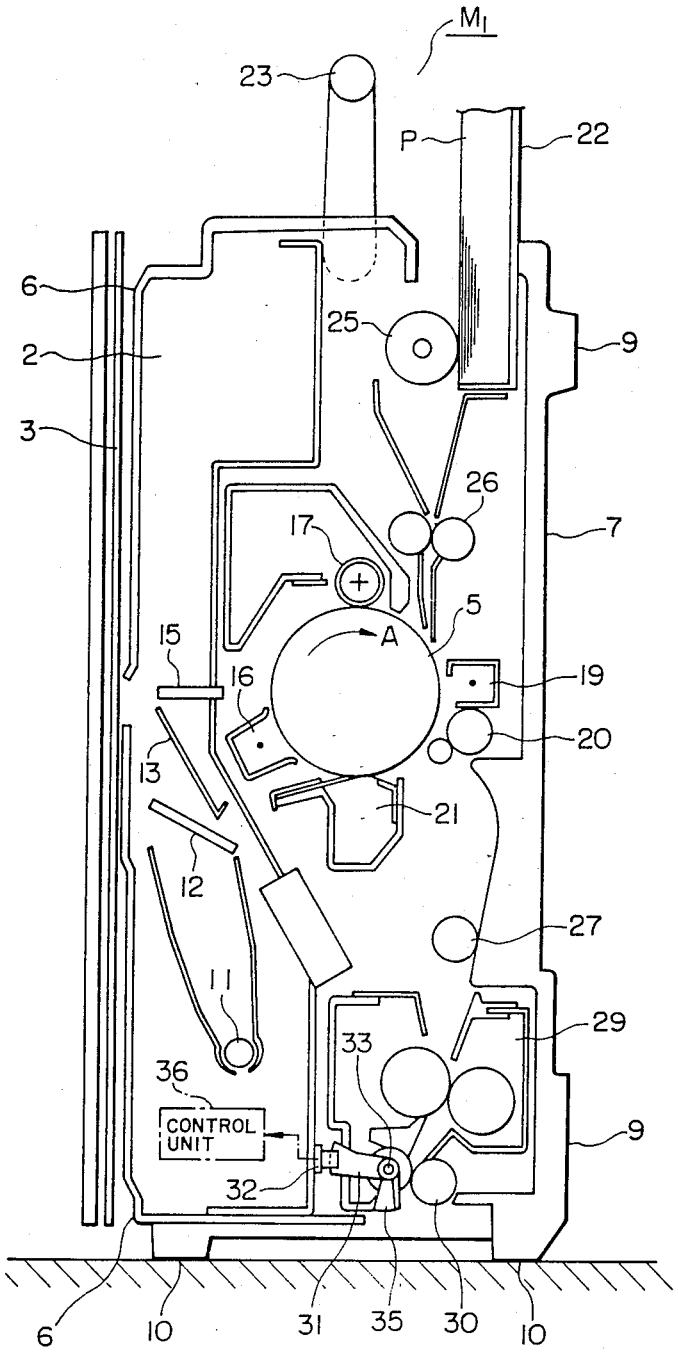
FIGS. 1 and 2 are cross-sectional views of a first embodiment of the copying machine using the present invention.
Figure 2:
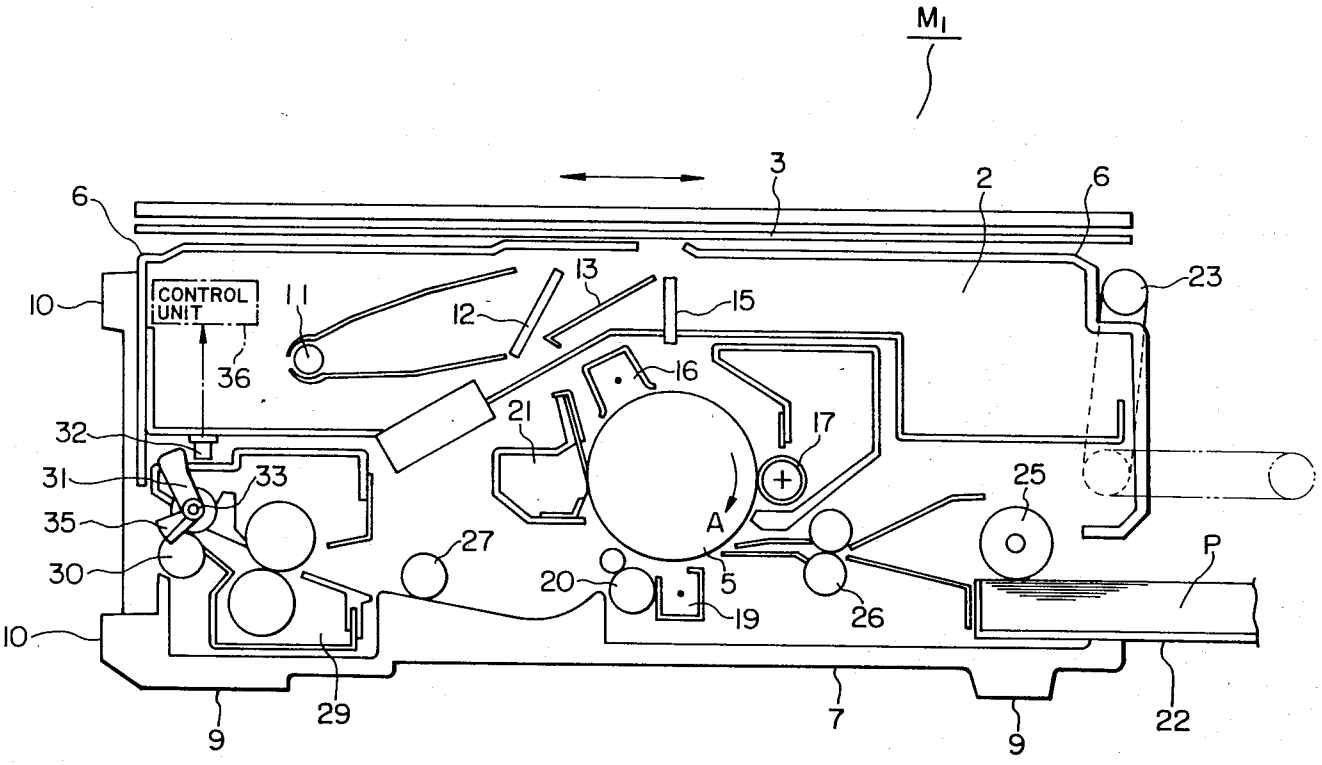

A copying machine $M_1$ according to a first embodiment of the present invention, as shown in FIG. 2, has an original carriage 3 movable back and forth above the apparatus body 2 and is provided with a photosensitive drum 5 rotatable in the direction of arrow A substantially centrally of the apparatus body 2. An upper housing 6 is formed so as to cover the apparatus body 2, and further a lower housing 7 is provided below the apparatus body 7, the lower housing 7 being formed with legs 9. During copying operation, the copying machine $M_1$ is adapted to be placed in a posture in which the legs 9 are in contact with the floor surface and the original carriage 3 is positioned horizontally above. Other legs 10 are provided on the rear of the apparatus body 2, and during non-use, the copying machine $M_1$ is adapted to be placed in a posture in which the legs 10 are in contact with the floor surface and the original carriage 3 is positioned substantially vertically (see FIG. 1). Further, below the original carriage 3, there are disposed an original illuminating lamp 11, a heat absorbing filter 12, a mirror 13 and an imaging element array 15, and the optical image of an original placed on the original carriage 3 may be scanned by these optical systems so that an electrostatic latent image may be formed on the photosensitive drum 5. Disposed around the photosensitive drum 5 are a primary charger 16, a developing device 17, a transfer charger 19, a separating and conveying roller 20 and a cleaner 21 so that the electrostatic latent image formed on the photosensitive drum 5 may be developed into a toner image which in turn may be transferred to a sheet material. A cassette 22 is removably disposed below the apparatus body 2 and a number of sheet materials P are contained in the cassette 22. A handle 23 is provided above the cassette 22 and is adapted to be received in the apparatus body 2 when the copying machine $M_1$ effects a copying operation and to be drawn out and gripped when the copying apparatus $M_1$ is carried. A paper feed roller 25 is provided facing the cassette 22 and further, register rollers 26 are disposed so as to feed the sheet materials P toward the photosensitive drum 5. A conveying roller 27 is provided in the lower and rearward portion of the apparatus body 2, a fixing device 29 is disposed further rearwardly of the conveying roller and discharge rollers 30 are disposed adjacent to the fixing device 29 so that the toner image transferred to the sheet materials P may be fixed and the sheet materials P may be discharged outwardly.

On the other hand, a bell-crank-shaped discharged paper detecting lever 31 is provided in proximity to the discharge rollers 30 and a photointerrupter 32 is disposed above the detecting lever 31. The discharged paper detecting lever 31 has its central portion pivotably supported on a shaft 33 and has a weight 35 secured to its lower end so that when a sheet material P is discharged out of the apparatus body 2 by the discharge rollers 30, the sheet material P may pivot the discharged paper detecting lever 31 to change the phase of the lever 31 and after the sheet material P has passed, the discharged paper detecting lever 31 may be returned to its initial position by the weight 35. When the phase of the discharged paper detecting lever 31 is changed, the fore end portion of the lever 31 may interrupt the photointerrupter 32 and the displacement of the discharged paper detecting lever 31 may be detected by the photointerrupter 32, from which a signal may be transmitted to a control unit 36. A timer is contained in the control unit 36 and is adapted to measure the time of displacement of the detecting lever 31 and to count the passage of sheet materials P when said time corresponds to the time of passage of sheet materials P. Further, when the apparatus body 2 is placed in its posture as shown in FIG. 1 wherein the original carriage 3 is positioned substantially vertically, the discharged paper detecting lever 31 may be displaced with the weight 35 being lowered and the fore end portion of the detecting lever 31 may interrupt the photointerrupter 32 so that the displacement of the detecting lever 31 may be detected by the photointerrupter 32. The displacement of the detecting lever 31 may then be transmitted to the control unit 36, in which the time of said displacement may be measured by the timer, and where said time differs from the time corresponding to said passage of sheet materials P, the control unit 36 may change over the copying machine $M_1$ to its inoperative condition and hold the machine in such inoperative condition.

Since the present embodiment is constructed as described above, the copying machine $M_1$ is placed in a posture in which the original carriage 3 is positioned horizontally above and further, the handle 23 is received in the apparatus body 2. An original is then placed on the original carriage 3 and, when the copying operation of the copying machine $M_1$ is started, the original carriage 3 is moved and the optical image of the original placed on the original carriage 3 is scanned on the photosensitive drum 5 and an electrostatic latent image is formed thereon, and the electrostatic latent image is developed into a toner image by the developing device 17. One of the sheet materials P contained in the cassette 22 is fed by the paper feed roller 25 and arrives at the photosensitive drum 5 through the register rollers 26, and has the toner image on the drum 5 transferred thereto and arrives at the fixing device 29. Further, the sheet material P has the toner image thereon fixed by the fixing device 29 and is discharged out of the apparatus body 2 via the discharge rollers 30, whereupon the copying operation of the copying machine $M_1$ is completed. When the copying operation is completed and the copying machine $M_1$ is to be preserved at some other suitable location, the handle 23 is drawn out and gripped and the copying machine $M_1$ is raised up and carried while being suspended in a posture in which the original carriage 3 is substantially vertical unlike during normal copying operation, and is placed at the suitable location. In this case, as shown in FIG. 1, the copying machine $M_1$ can be placed in a posture in which the legs 10 and 10 thereof are in contact with the floor surface and the original carriage 3 is positioned substantially vertical, and can therefore be preserved in a narrow space When the apparatus body 2 is placed in such posture different from the posture during the copying operation, the discharged paper detecting lever 31 is displaced with the weight 35 lowering, and the fore end portion of the detecting lever 31 interrupts the photointerrupter 32 and the displacement of the detecting lever 31 is detected by the photointerrupter 32. The displacement of the detecting lever 31 is transmitted to the control unit 36 and the time of the displacement is measured by the timer and where this time is longer than the time corresponding to the passage of the sheet material P, the control unit 36 changes over the copying machine M to its inoperative condition and holds same in such condition. Even if the copy start button is depressed by mistake during the transportation or preservation of the copying machine $M_1$, the copying operation will never be started as long as the handle 30 in its drawn-out position and thus, the original carriage 3, etc. will not be moved to damage the apparatus.

Figure 7:
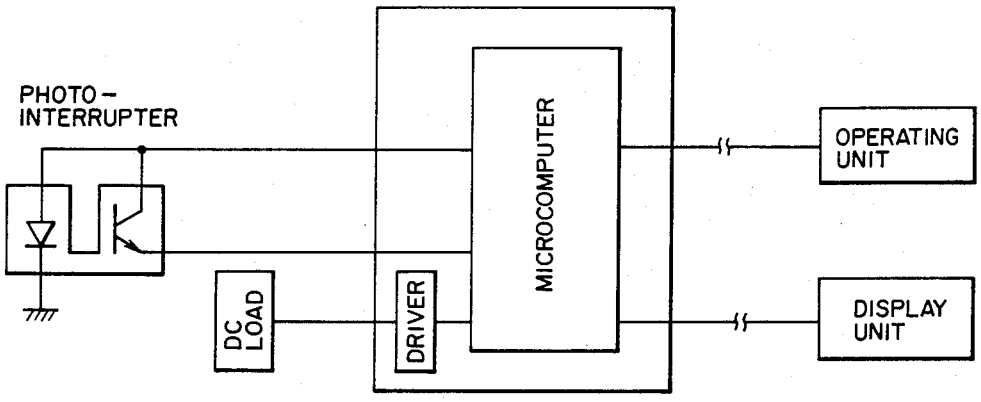
FIG. 7 is a block diagram of the control unit in the first embodiment.
Figure 8:
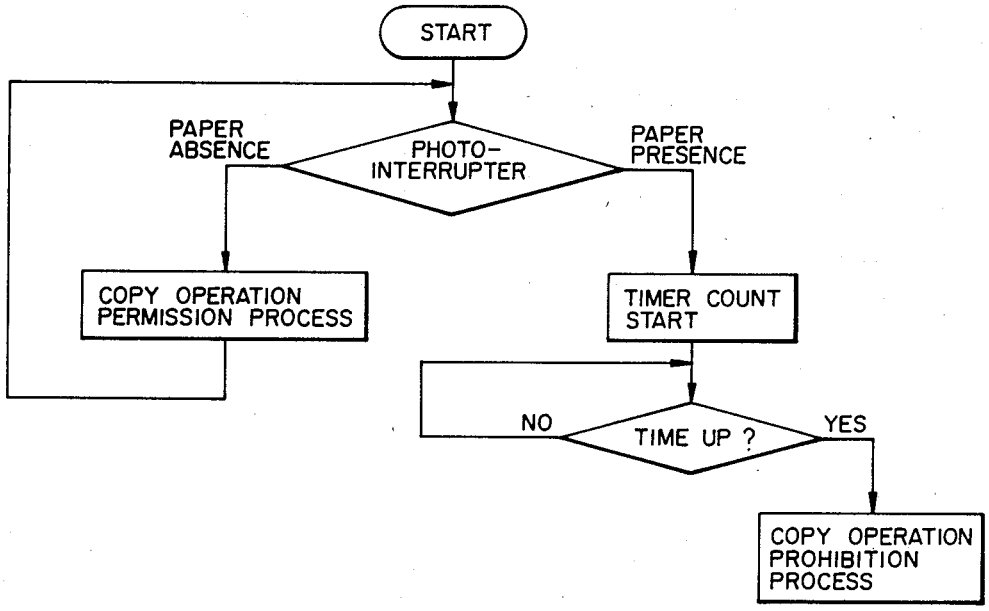
FIG. 8 is a flow chart of the control unit in the first embodiment.

A block diagram of the control unit of the present embodiment is shown in FIG. 7 and the flow chart thereof is shown in FIG. 8.

When the copying machine $M_1$ is returned to its posture during the normal copying operation, the discharged paper detecting lever 31 is displaced by the weight 35 and the fore end portion of the detecting lever 31 no longer interrupts the photointerrupter 32, and the displacement of the detecting lever 31 is detected by the photointerrupter 32 and this displacement is transmitted to the control unit 36, whereby the copying machine $M_1$ is released from its inoperative condition.

Figure 3:
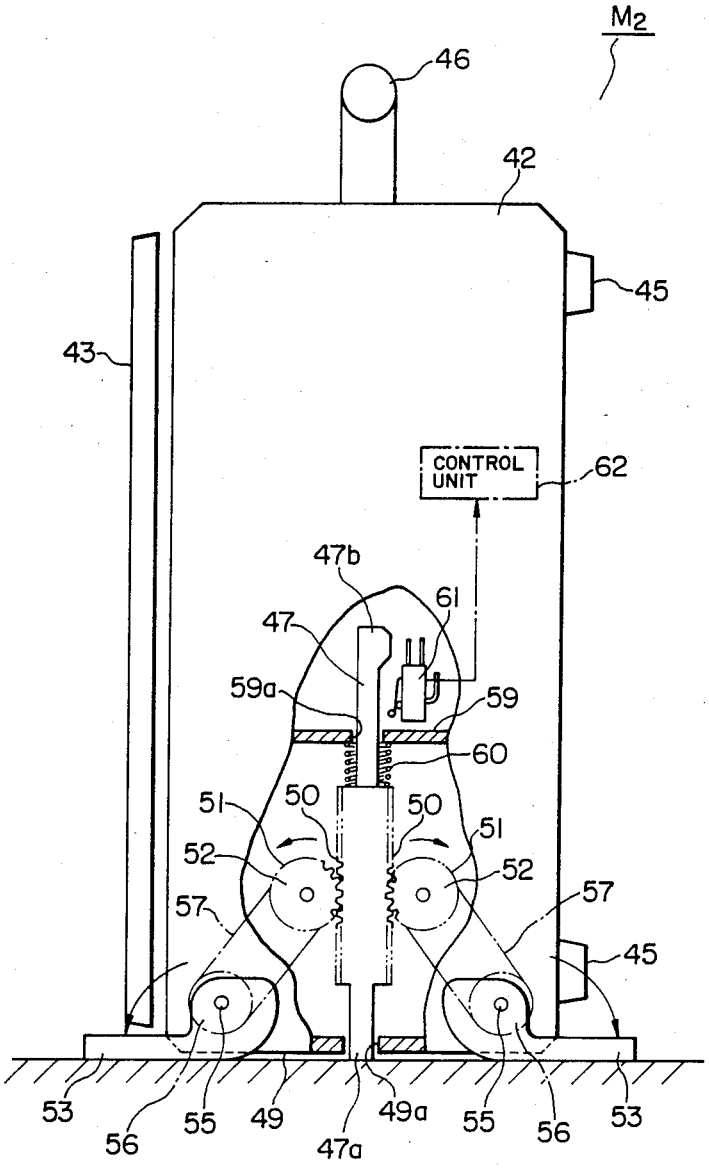
FIGS. 3 and 4 are cross-sectional views of a second embodiment of the copying machine using the present invention.

A second embodiment will now be described with reference to FIGS. 3 and 4.

Figure 4:
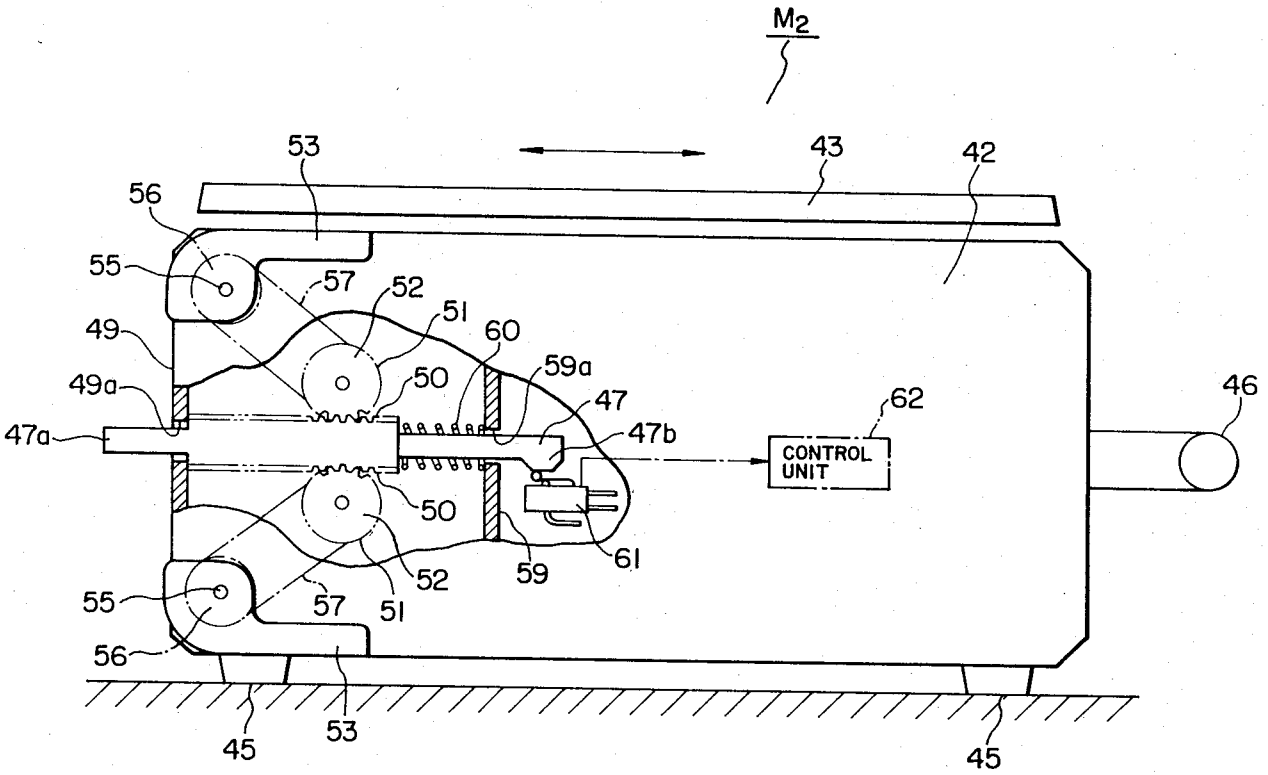

The copying machine $M_2$ according to the present embodiment, as shown in FIG. 4, has an apparatus body 42 and is provided with an original carriage 43 movable back and forth above the apparatus body 42. Legs 45 and 45 are formed below the apparatus body 42 and during the copying operation, the copying machine $M_2$ is adapted to be placed in a posture in which these legs 45 and 45 are in contact with the floor surface and the original carriage 43 is positioned horizontally above. A handle 46 is provided on a side of the apparatus body 42 and the copying machine $M_2$ may be carried with the handle 46 gripped when it is to be transported to a suitable location.

The copying machine $M_2$ is provided with various members necessary for copying operation such as a photosensitive drum, etc., not shown, in the apparatus body 42, but those members are similar to those of the copying machine $M_1$ of the above-described first embodiment and therefore need not be described. A switch lever 47 is contained in the rear of the apparatus body 42 and a hole 49*a* is formed in the rear side surface 49 of the apparatus body 42 which faces the switch lever 47 so that the rear end portion 47*a* of the switch lever 47 can project outwardly from the hole 49*a*. Rack gears 50 are formed on the opposite sides of the enlarged central portion of the switch lever 47, and pinion gears 51 are disposed in face-to-face relationship with these rack gears 50, respectively, and are in mesh engagement with the rack gears 50, respectively. Main pulleys or sprocket wheels 52 are provided coaxially with the pinion gears 51, respectively, and are rotatable with the pinion gears 51, respectively. A pair of openable-closable legs 53 are disposed adjacent to the rear side wall 49 of the apparatus body 42 and supported by support shafts 55, respectively. Follower pulleys or sprocket wheels 56 are further supported on these shafts 55 and are rotatable with said pair of openable-closable legs 53. Wires or chains 57 are passed over and between the follower pulleys or sprocket wheels 56, supported on the shafts 55, and the main pulleys or sprocket wheels 52, and when the rear end portion 47*a* of the switch lever 47 is urged inwardly and the switch lever 47 is moved inwardly thereby, the openable-closable legs 53 may project outwardly of the apparatus body 42 at a time and come into contact with the floor surface as shown in FIG. 3 through the rack gears 50, the pinion gears 51, the main pulley or sprocket wheels 52, the wires or chains 57 and the follower pulleys or sprocket wheels 56, thereby preventing the copying machine $M_2$ from falling down even if it is placed with its longitudinal axis disposed vertically. Further, the fore end portion 47*b* of the switch lever 47 protrudes forwardly in the apparatus body 42 through a hole 59*a* formed in the partition wall 59 of the apparatus body 42, and a coil spring 60 is provided between the enlarged central portion of the switch lever 47 and the partition wall 59 to bias the switch lever 47 so that its rear end portion 47*a* protrude outwardly. On the other hand, a switch 61 is disposed correspondingly to the fore end portion 47*b* of the switch lever 47 so that when the rear end portion of the switch lever 47 protrudes outwardly, the fore end portion 47*b* of the switch lever 47 may be in contact with the switch 61 and that when the rear end portion 47*a* is urged inwardly and the switch lever 47 is displaced inwardly, the fore end portion 47*b* of the switch lever 47 may separate from the switch 61, whereby a signal from the switch 61 may be transmitted to a control unit 62, which will thus change over the copying machine $M_2$ to its inoperative condition and hold same in such condition.

The present second embodiment is constructed as described above and therefore, when the copying machine $M_2$ is placed in a posture in which the original carriage 43 is positioned horizontally above as during the copying operation, the process from the time when the image of the original on the original carriage 43 is transferred to a sheet material P till the time when the sheet material P is discharged from the apparatus body 42 and the copying operation of the copying machine $M_2$ is completed is similar to that described above with respect to the first embodiment and therefore need not be described.

When the copying operation is completed, the copying machine $M_2$ may be carried to a suitable location with the handle 46 being gripped and while being suspended in a posture in which the original carriage 43 is substantially vertical unlike during the normal copying operation. When the copying machine $M_2$ is placed on the floor with the handle 46 positioned above and the original carriage 43 positioned substantially vertically as shown in FIG. 3, the switch lever 47 has its rear end portion 47*a* urged against the floor surface and is moved inwardly against the force of the coil spring 60. When the switch lever 47 is thus moved inwardly, the enlarged central portion of this lever 47 is moved, whereby the pinion gears 51 which are in mesh engagement with the rack gears 50 formed on the enlarged central portion are rotated. Further, with the rotation of the pinion gears 51, the main pulleys or sprocket wheels 52 rotatable with the pinion gears 51 are rotated and further, the follower pulleys or sprocket wheels 56 are rotated through the intermediary of the wires or chains 57, whereby the pair of openable-closable legs 53 are pivotally moved and protrude outwardly of the apparatus body 42. These openable-closable legs 53 thus come into contact with the floor surface and the copying machine $M_2$ is placed on the floor without falling down. Also, the switch lever 47 is displaced inwardly and the fore end portion 47*b* thereof becomes separate from the switch 61, and the displacement of the switch lever 47 is detected by the switch 61. Said displacement is transmitted to the control unit 62, which thus changes over the copying machine $M_2$ to its inoperative condition and holds same in such condition. When the copying machine $M_2$ is then returned to its posture during the normal copying operation, the switch lever 47 is moved outwardly by the coil spring 60 and the openable-closable legs 53 are folded into the apparatus and further, the rear end portion 47*b* of the switch lever 47 comes into contact with the switch 61 and thus, the displacement of the switch lever 47 is transmitted to the control unit 62, whereby the copying machine $M_2$ is released from its inoperative condition.

Figure 9:
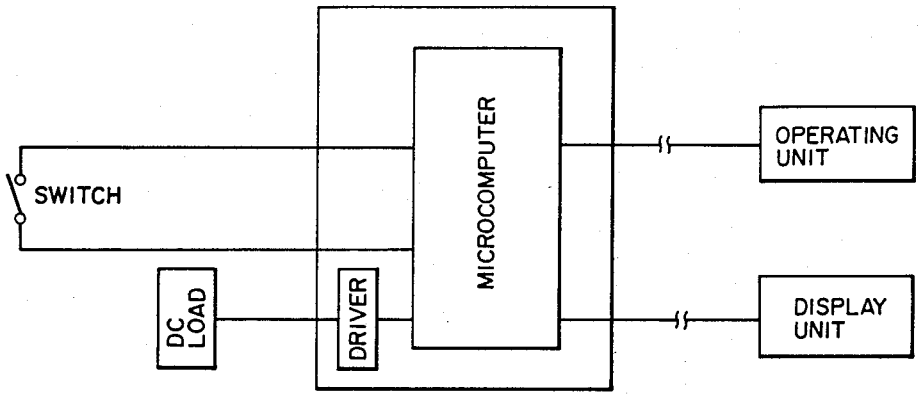
FIG. 9 is a block diagram of the control unit in the second embodiment.
Figure 10:
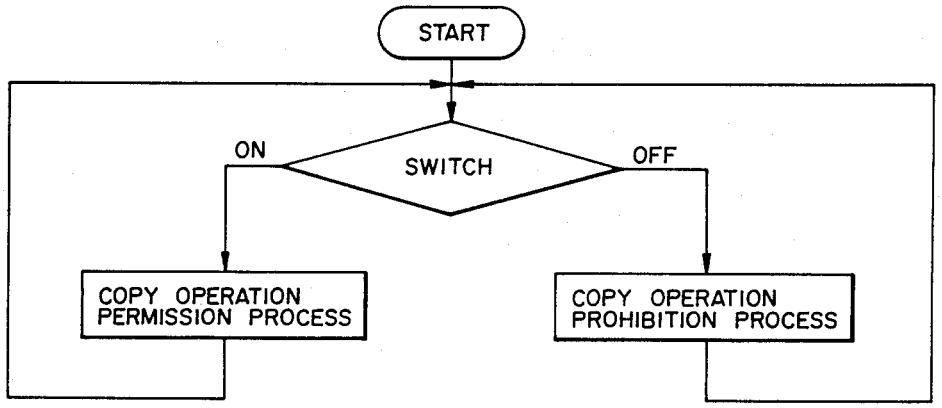
FIG. 10 is a flow chart of the control unit in the second embodiment.

A block diagram of the control unit in the present embodiment is shown in FIG. 9, and a flow chart is shown in FIG. 10.

Figure 5:
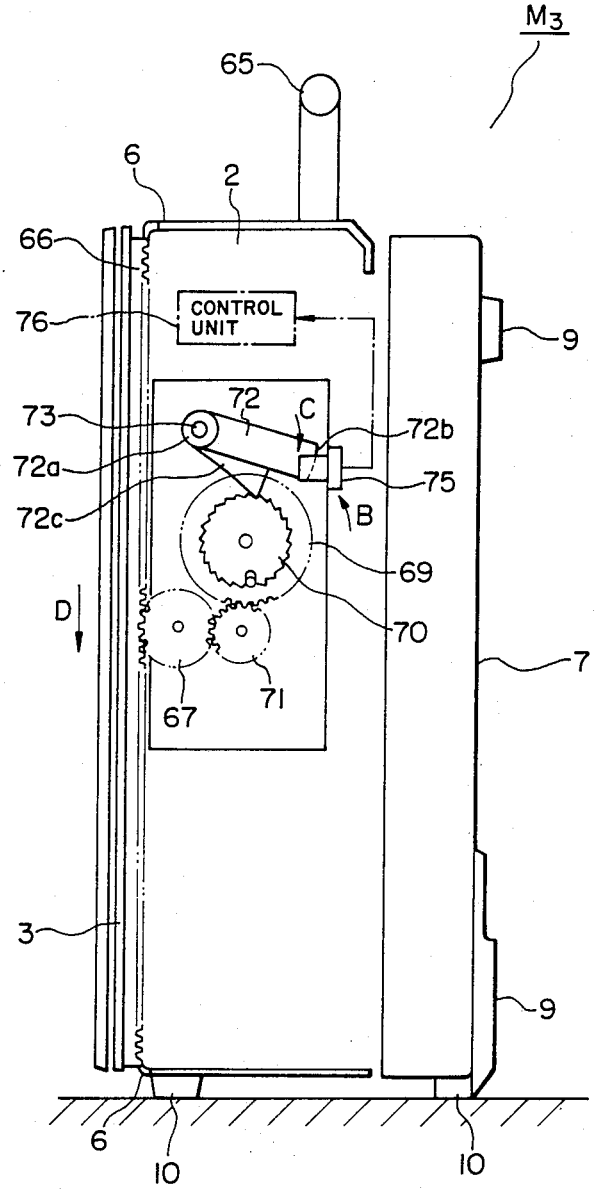
FIGS. 5 and 6 are cross-sectional views of a third embodiment of the present invention.
Figure 6:
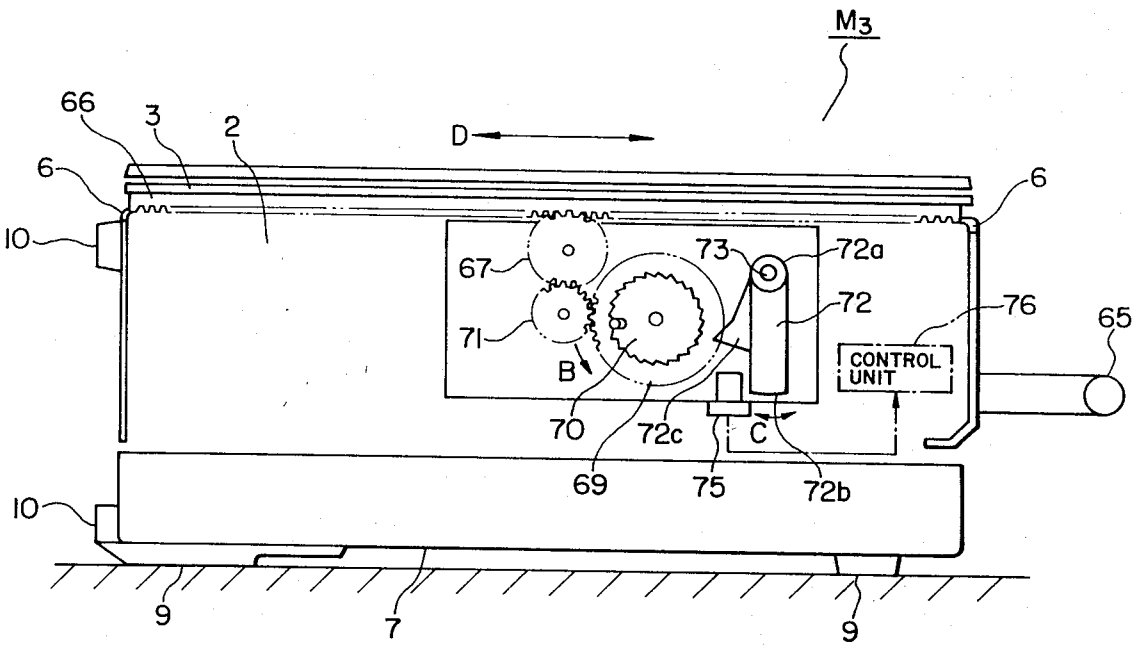

A third embodiment will now be described with reference to FIGS. 5 and 6. The portions of this embodiment which are similar to those of the copying machine $M_1$ of the above-described first embodiment are given similar reference numerals and need not be described.

The copying machine $M_3$ of the present embodiment has an original carriage 3 above the apparatus body 2 and has therein various members necessary for the copying operation such as a photosensitive drum, etc. not shown, but those various members are similar to those of the copying machine $M_1$ of the first embodiment and therefore need not be described. A handle 65 is provided on a side of the apparatus body 2 so that the copying machine $M_3$ can be carried with the handle 65 gripped when it is to be moved to a suitable location. A rack gear 66 is integrally secured to the original carriage 3 and a pinion gear 67 is disposed below the original carriage 3 and adapted to mesh with the rack gear 66. An output gear 69 for backward movement is disposed near the pinion gear 67 and a ratchet 70 is integrally secured to the output gear 69 for backward movement. An output gear 71 for forward movement is provided so as to mesh with both of the pinion gear 67 and the output gear 69 for backward movement, and a drive force from a drive source, not shown, may be transmitted to one of the output gear 71 for forward movement and the output gear 69 for backward movement by clutch means, not shown, so as to rotate the pinion gear 67 in a forward direction or a reverse direction and thereby move the original carriage 3 back and forth through the intermediary of the rack gear 66 meshing with the pinion gear 67. An original carriage fall preventing lever 72 is disposed in face-to-face relationship with the ratchet 70, and a support shaft 73 is fitted in the fore end portion 72*a* of the lever 72, and the lever 72 hangs on the support shaft 73, the rear end portion 72*b* of the lever 72 being swingable so that the lever 72 hangs downwardly from gravity when the posture of the apparatus body 2 is changed. Further, a ratchet pawl 72*c* is formed on a side of the lever 72 so that when the rear end portion 72*b* of the lever 72 is moved in the direction of arrow C toward the ratchet 70 as by a change in the posture of the apparatus body 2, the ratchet pawl 72*c* may come into engagement with the ratchet 70 to control the rotation of the output gear 69 for backward movement in the direction of arrow B and control the movement of the original carriage 3 in the direction of arrow D through the intermediary of the output gear 71 for forward movement, the pinion gear 67 and the rack gear 66 and that the original carriage 3 may be prevented from falling from gravity when the copying machine $M_3$ is placed in a posture in which the original carriage 3 is substantially vertical with the handle 65 positioned above. Further, a photointerrupter 75 is disposed in face-to-face relationship with the rear end portion 72*b* of the original carriage fall preventing lever 72 so that when the lever 72 moves toward the ratchet 70 to change the phase, the rear end portion 72*b* of the lever 72 may interrupt the photointerrupter 75 and the displacement of the lever 72 may be detected by the photointerrupter 75, whereupon the signal from the photointerrupter 75 may be transmitted to a control unit 76, which will thus change over the copying machine $M_3$ to its inoperative condition and hold same in such condition.

Figure 11:
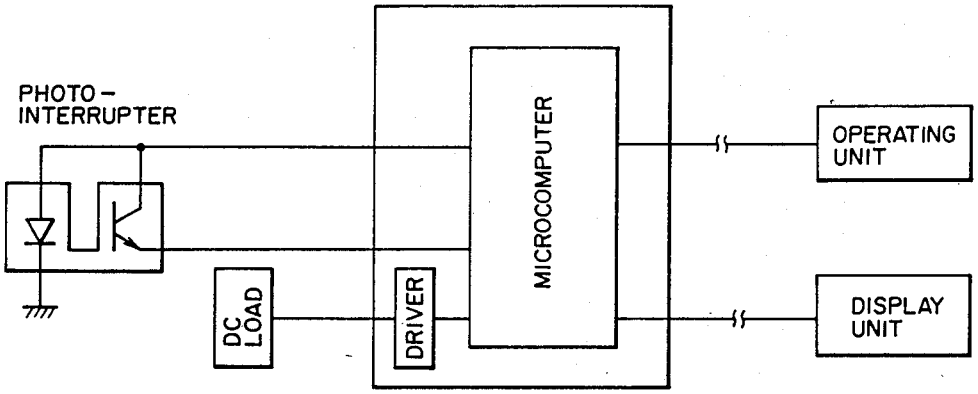
FIG. 11 is a block diagram of the control unit in the third embodiment.
Figure 12:
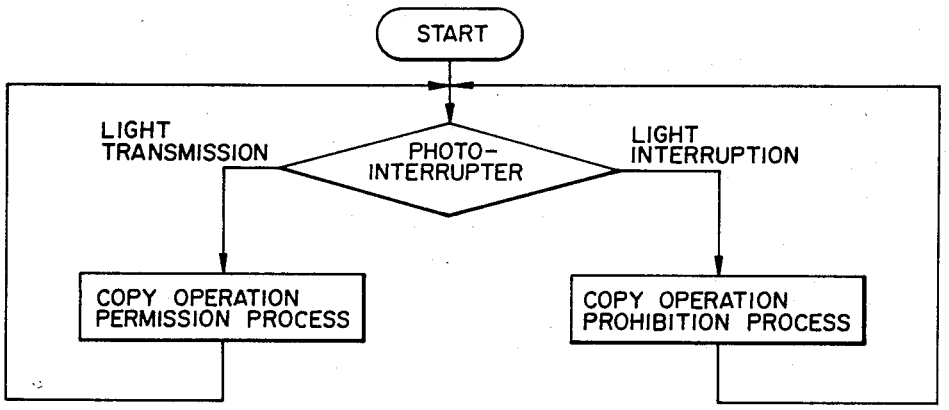
FIG. 12 is a flow chart of the control unit in the third embodiment.

A block diagram of the control unit in the present embodiment is shown in FIG. 11, and a flow chart is shown in FIG. 12.

The present third embodiment is constructed as described above, and where the copying machine $M_3$ is placed in the posture during the copying operation in which the original carriage 3 is positioned horizontally above, the process from the time when the image of an original on the original carriage 3 is transferred to a sheet material P till the time when the sheet material P is discharged from the apparatus body 2 and the copying operation of the copying machine $M_3$ is completed is similar to that described above with respect to the first embodiment and therefore need not be described.

Upon completion of the copying operation, the copying machine $M_3$ is carried to and placed at a suitable location with the handle 65 gripped while being suspended in a posture in which the original carriage 3 is substantially vertical unlike during the normal copying operation. In this case, the copying machine $M_3$ can be placed in a vertically upright posture in which, as shown in FIG. 5, the legs 10 and 10 are in contact with the floor surface and the original carriage 3 is positioned substantially vertically and therefore, the copying machine can be preserved in a narrow space. When the apparatus body 2 is placed in the posture in which the handle 65 is positioned above and the original carriage 3 is positioned substantially vertically unlike during the copying operation, the rear end portion 72*b* of the original carriage fall preventing lever 72 moves toward the ratchet 70 (in the direction of arrow C) and thus, the original carriage fall preventing lever 72 is displaced. Thereupon, the ratchet pawl 72*c* of the lever 72 comes into engagement with the ratchet 70 to control the rotation of the output gear 69 for backward movement in the direction of arrow B and control the movement of the original carriage 3 in the direction of arrow D through the intermediary of the output gear 71 for forward movement, the pinion gear 67 and the rack gear 66, thereby preventing the original carriage 3 from falling from gravity. Further, the rear end portion 72*b* of the original carriage fall preventing lever 72 interrupts the photointerrupter 75 and the displacement of the lever 72 is detected by the photointerrupter 75. The displacement of the lever 72 is transmitted to the control unit 76, which thus renders the copying machine $M_3$ inoperative. Also, when the copying machine $M_3$ is returned to its posture during the normal copying operation, the original carriage fall preventing lever 72 is displaced and the engagement between the ratchet pawl 72*c* of the lever 72 and the ratchet 70 is released while, at the same time, the rear end portion 72*b* of the lever 72 no longer interrupts the photointerrupter 75 and the displacement of the original carriage fall preventing lever 72 is detected by the photointerrupter 75, and this displacement is transmitted to the control unit 76, whereby the copying machine $M_3$ is released from its inoperative condition.

Figure 13:
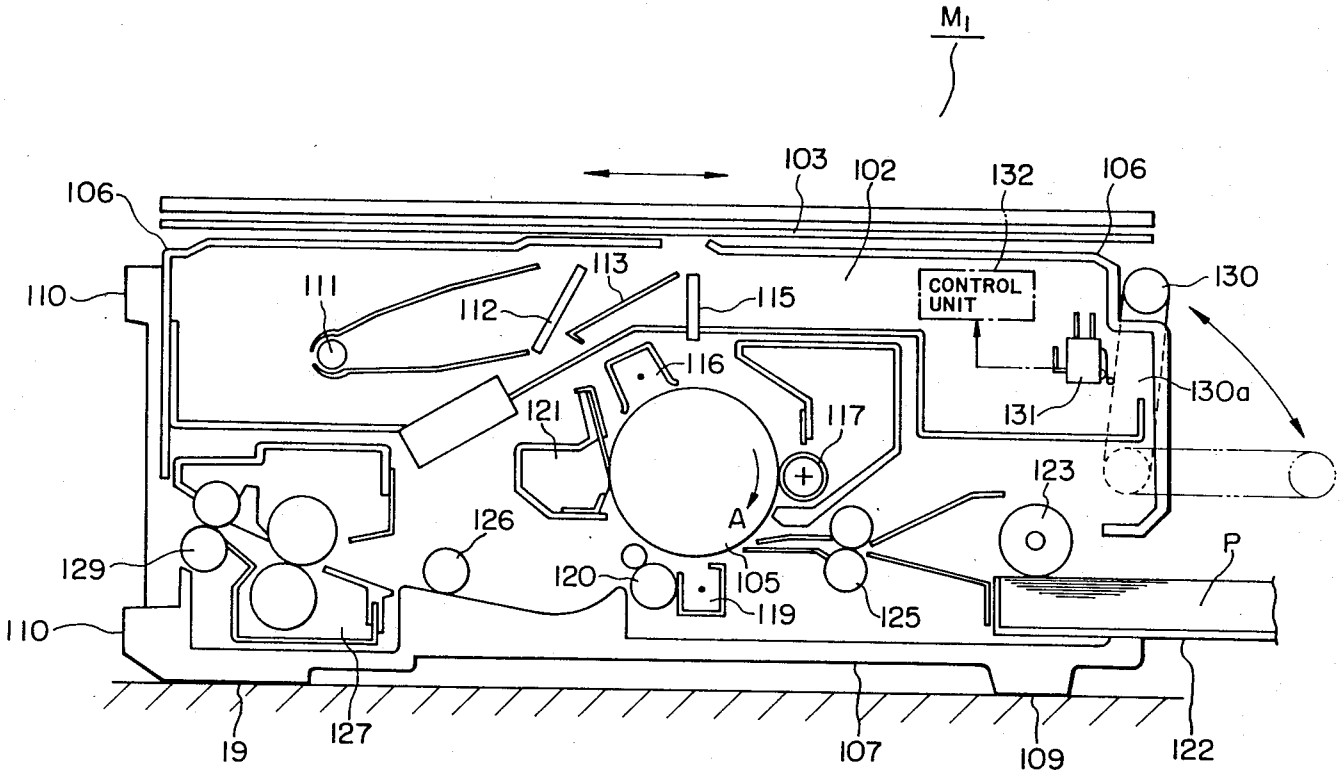
FIG. 13 is a cross-sectional view of a fourth embodiment of the copying machine using the present invention.

A copying machine $M_1$ according to a fourth embodiment of the present invention, as shown in FIG. 13, has an original carriage 103 movable back and forth above the apparatus body 102 and is provided with a photosensitive drum 105 rotatable in the direction of arrow A substantially centrally of the apparatus body 102. An upper housing 106 is formed so as to cover the apparatus body 102, a lower housing 107 is provided below the apparatus body 102, and the lower housing 107 is formed with legs 109 so that during the copying operation, the copying machine $M_1$ may be placed in a posture in which the legs 109 are in contact with the floor surface and the original carriage 103 is positioned horizontally above. Other legs 110 are provided on the rear of the apparatus body 102, and the copying machine $M_1$, when not in use and preserved at a suitable location, may be placed in a posture in which the legs 110 are in contact with the floor surface and the original carriage 103 is positioned substantially vertical. Further provided below the original carriage 103 are an original illuminating lamp 111, a heat absorbing filter 112, a mirror 113 and an imaging element array 115 so that the optical image of an original placed on the original carriage 103 may be scanned by these optical systems and an electrostatic latent image may be formed on the photosensitive drum 105. Disposed around the photosensitive drum 105 are a primary charger 116, a developing device 117, a transfer charger 119, a separating and conveying roller 120 and a cleaner 121 so that the electrostatic latent image formed on the photosensitive drum 105 may be developed into a toner image, which in turn may be transferred to a sheet material. A cassette 122 is removably disposed below the apparatus body 102, and a number of sheet materials P are contained in the cassette 122. A paper feed roller 123 is provided above the cassette 122 and further, register rollers 125 are disposed to feed the sheet materials P toward the photosensitive drum 105. A conveying roller 126 is provided in the lower and rear portion of the apparatus body 102, a fixing device 127 is disposed rearwardly of the conveying roller 126 and discharge rollers 129 are disposed adjacent to the fixing device 127 so that the toner image transferred to the sheet material P may be fixed and the sheet material may be discharged outwardly.

On the other hand, a handle 130 is provided above the cassette 122. The handle 130 is adapted to be received in the apparatus body 102 during the copying operation of the copying machine $M_1$, and to be drawn out and gripped when the copying machine $M_1$ is to be carried. A switch 131 is disposed adjacent to the arm portion 130*a* of the handle 130, and when the handle 130 is received in the apparatus body 102, the arm portion 130*a* of the handle 130 is in contact with the switch 131, and when the handle 130 is drawn out and its position is changed, the arm portion 130*a* separates from the switch 131 and the change in the position of the handle 130 is detected by the switch 131, and the signal from the switch 131 is transmitted to a control unit 132, which will thus change over the copying machine $M_1$ to its inoperative condition and hold same in such condition.

The present fourth embodiment is constructed as described above and therefore, the copying machine $M_1$ is placed in the posture during the copying operation in which the original carriage 103 is positioned horizontally above and further, the handle 123 is received into the apparatus body 102. An original is then placed onto the original carriage 103 and the copying operation of the copying machine $M_1$ is started, whereupon the original carriage 103 is moved and the optical image of the original placed on the original carriage 103 is scanned on the photosensitive drum 105, whereby an electrostatic latent image is formed and this electrostatic latent image is developed into a toner image by the developing device 117. One of the sheet materials P contained in the cassette 122 is fed by the paper feed roller 126 and arrives at the photosensitive drum 105, and the toner image on the drum 105 is transferred to the sheet material P, which is then passed to the fixing device 127. The sheet material P has the toner image thereon fixed by the fixing device 127 and is discharged out of the apparatus body 102 via the discharge rollers 129, thus completing the copying operation of the copying machine $M_1$. When the copying machine $M_1$ is to be preserved at other suitable location upon completion of the copying operation, the handle 130 is drawn out and gripped, whereby the copying machine $M_1$ is raised up and carried to and placed at a suitable location while being suspended in a posture in which the original carriage 103 is substantially vertical unlike during the normal copying operation. In this case, the copying machine $M_1$ can be placed in its vertically long posture in which the legs 110 are in contact with the floor surface and the original carriage 103 is positioned substantially vertically, and therefore it can be preserved even in a narrow space. The handle 130 is then drawn out prior to the copying machine $M_1$ being carried, and the arm portion 130*a* of the handle 130 separates from the switch 131 and thus, the contact between the switch 131 and the arm portion 130*a* is released and the change in the position of the handle 130 is detected by the switch 131. The signal from the switch 131 is transmitted to the control unit 132, which thus changes over the copying machine $M_1$ to its inoperative condition and holds same in such condition. Accordingly, even if a copy start button is depressed by mistake during the transportation or preservation of the copying machine $M_1$, the copying operation will not be started as long as the handle 130 is in its drawn-out position, and thus the original carriage 103, etc. will not move to damage the apparatus.

Also, when the copying machine $M_1$ is placed in its posture during the normal copying operation and the handle 130 is received into the apparatus body 102, the return of the position of the handle 130 is detected by the switch 131 and the copying machine $M_1$ is released from its inoperative condition.

Figure 14:
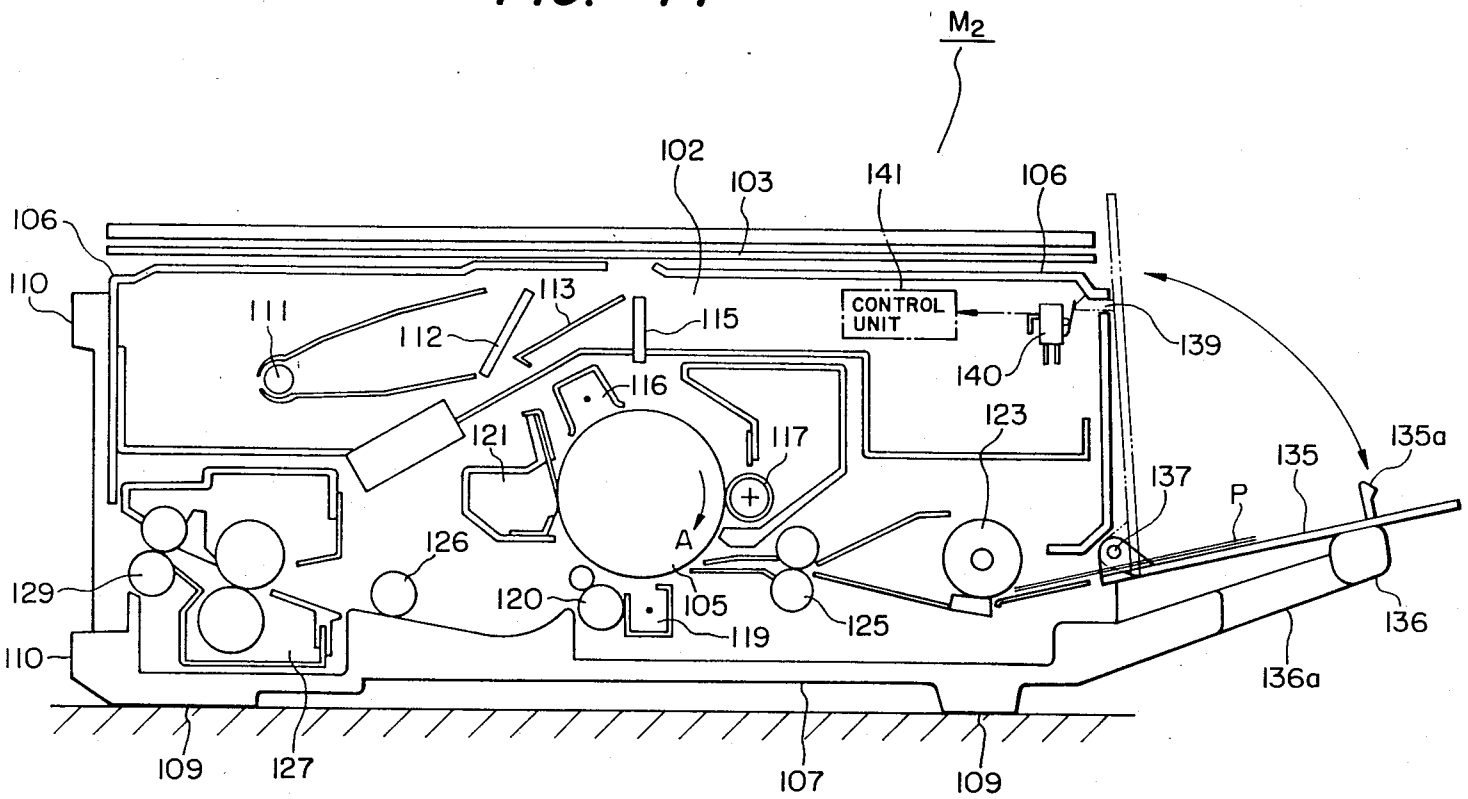
FIG. 14 is a cross-sectional view of a fifth embodiment of the copying machine using the present invention.

A fifth embodiment will now be described with reference to FIG. 14. The portions of the fifth embodiment which are similar to those of the above-described fourth embodiment are given similar reference numerals and need not be described.

In the above-described fourth embodiment, the copying machine $M_1$ has the cassette 122 containing a number of sheet materials P therein, while the copying machine $M_2$ of the present embodiment is provided with a paper supply tray 135 instead of the cassette. A handle 136 is disposed below the tray 135 and the arm portion 136*a* of the handle 136 is secured to a lower housing 107 so that the copying machine $M_2$ can be carried while being suspended with the handle 136 being gripped. The paper supply tray 135 has its rear end rotatably supported on a support shaft 137 so as to be swingable up and down, and further, a convex engaging portion 135*a* is formed on the fore end of the tray 135 and is engageable with an engaging hole 139 formed in a side of the upper housing 106 of the apparatus body 102. During the copying operation of the copying machine $M_2$, the paper supply tray 135 is adapted to bear against the handle 136 so as to permit sheet materials P to be placed thereon, and further, when the copying machine $M_2$ is to be carried, the tray 135 may be moved upwardly and received in a side of the upper housing 106 of the apparatus body 102 so as not to hamper the handle 136 from being gripped. In that case, the engaging portion 135*a* of the paper supply tray 135 may fit into the engaging hole 139 for gripping, whereby the paper supply tray 135 may be held in that position. A switch 140 is disposed in proximity to the engaging hole 139 so that when the engaging portion 135*a* fits into the engaging hole 139, the engaging portion 135*a* may come into contact with the switch 140 and the change in the position of the paper supply tray 135 may be detected by the switch 140 and the signal from the switch 140 may be transmitted to a control unit 141, which will thus change over the copying machine $M_2$ to its inoperative condition and hold same in such condition.

The present fifth embodiment is constructed as described above and therefore, the copying machine $M_2$ is placed in its posture during the copying operation in which the original carriage 103 is positioned horizontally above, and further, the paper supply tray 135 is moved to a position in which it bears against the handle 136, and then sheet materials P are placed onto the paper supply tray 135. The process from the time when the image of an original on the original carriage 103 is transferred to a sheet material P till the time when the sheet material P is discharged from the apparatus body 142 to complete the copying operation of the copying machine $M_2$ is similar to that described above with respect to the fourth embodiment and therefore need not be described.

Further, when the copying machine $M_2$ is to be preserved at other location upon completion of the copying operation, the paper supply tray 135 is moved upwardly in advance and is received into a side of the upper housing of the apparatus body 102, whereupon the engaging portion 135*a* of the paper supply tray 135 fits into and is gripped by the engaging hole 139 formed in a side of the housing 106, whereby the paper supply tray 135 is held in that position. When the engaging portion 135*a* fits into the engaging hole 139, the engaging portion 135*a* comes into contact with the switch 140 and the change in the position of the paper supply tray 135 is detected by the switch 140. Thereupon, the signal from the switch 140 is transmitted to the control unit 141, which thus changes over the copying machine $M_2$ to its inoperative condition and holds same in such condition. Even if the copy start button is depressed by mistake when the copying machine $M_2$ is being carried or preserved, the copying operation will not be started and thus, the original carriage 103, etc. will not move to damage the apparatus.

Also, when the copying machine $M_2$ is placed in its posture during the normal copying operation and the paper supply tray 135 is separated from the side surface of the upper housing 106 of the apparatus body 102 and is returned to the position in which it bears against the handle 136, the return of the position of the paper supply tray 135 is detected by the switch 140 and the copying machine $M_2$ is released from its inoperative condition.

In the present embodiment, the design is made such that the change in the position of the paper supply tray is detected to render the copying machine inoperative, but alternatively, a design may be made such that the change in the position of the paper discharge tray is detected.

A sixth embodiment will now be described with reference to FIGS. 15 and 16.

Figure 15:
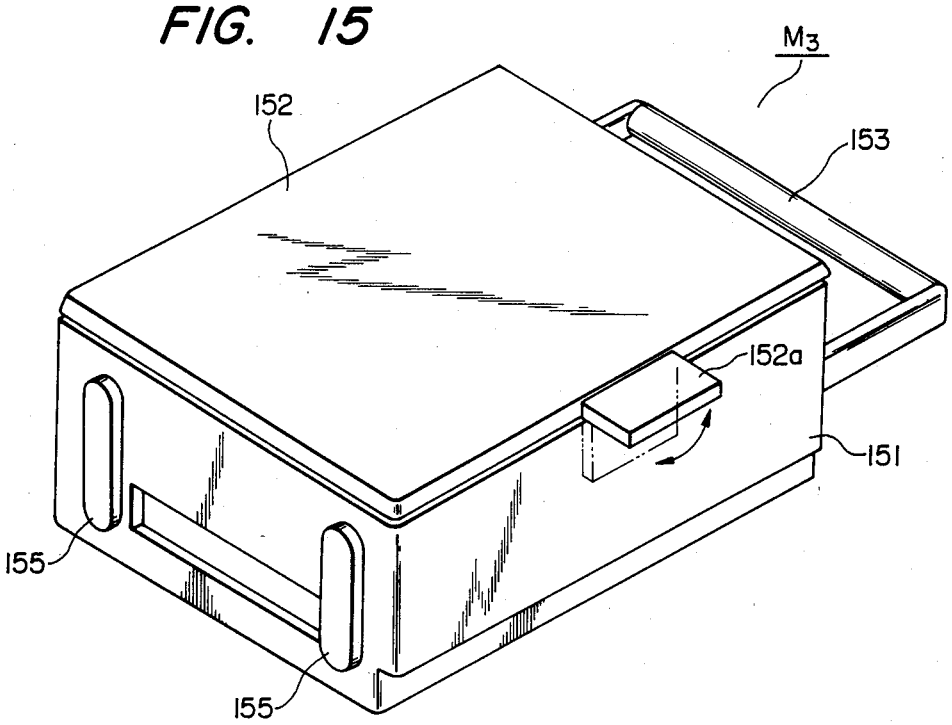
FIG. 15 is a perspective view of a sixth embodiment of the copying machine using the present invention.
Figure 16:
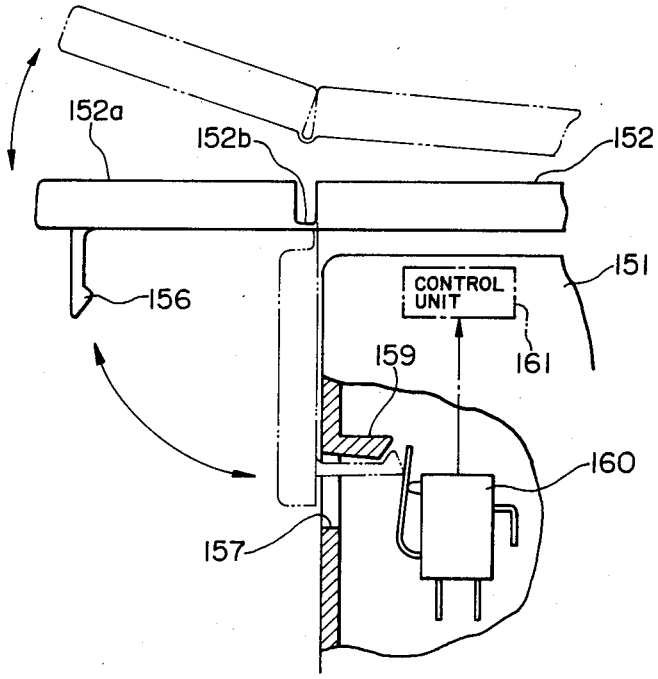
FIG. 16 is an enlarged view of the handle portion of the original pressing plate in the sixth embodiment.

The copying machine $M_3$ of the sixth embodiment, as shown in FIG. 15, has a substantially quadrilateral apparatus body 151 and is provided with an original pressing plate 152 on the upper surface thereof. A handle 153 is secured to one side of the apparatus body 151 so that the copying machine $M_3$ can be carried to a suitable location with the handle 153 gripped. Legs 155 are formed on the other side of the apparatus body 151 so that the copying machine $M_3$ can be placed in a vertically upright posture in which the legs 155 are in contact with the floor surface and the handle 153 is positioned above when the copying machine $M_3$ is carried to and preserved at a suitable location. The copying machine $M_3$ has in the apparatus body 151 various members necessary for the copying operation such as a photosensitive drum, etc., not shown, but those members are similar to those of the copying machine $M_1$ of the above-described fourth embodiment and therefore need not be described. The aforementioned original pressing plate 152 is formed of an elastic plastic material such as polypropylene, and a handle portion 152*a* is integrally formed on one side edge of the original pressing plate 152. The handle portion 152*a* is bendable at a hinge portion 152*b* formed between the original pressing plate 152 and the apparatus body, as shown in FIG. 16, and an engaging piece 156 is formed on the fore end of the handle portion 152*a*. On the other hand, an engaging hole 157 is formed in the apparatus body 151 correspondingly to the engaging piece 156 and further, an engaging portion 159 is disposed on the apparatus body so that when the handle portion 152*a* is bent and its position is changed, the engaging piece 156 may come into engagement with the engaging portion 159 to fix the handle portion 152*a* to the apparatus body 151 and thereby prevent the original pressing plate 152 from flapping or opening during the transportation and/or preservation of the copying machine or prevent the original carriage from moving during such time. Further, a switch 166 is disposed adjacent to the engaging portion 159 so that when the engaging piece 156 comes into engagement with the engaging portion 159, the engaging piece 156 may come into contact with the switch 160 and the change in the position of the handle portion 152*a* may be detected by the switch 160 and the signal from the switch 160 may be transmitted to a control unit 161, which will thus change over the copying machine $M_3$ to its inoperative condition and hold same in such condition.

The present sixth embodiment is constructed as described above and therefore, the copying machine $M_3$ is placed in a posture during the copying operation in which the original pressing plate 152 is positioned horizontally above, and further, the handle portion 152*a* of the original pressing plate 152 is released from its fixing to the apparatus body 151 and moved upwardly. The process from the time when an original on the original carriage is copied on a sheet material till the time when the sheet material is discharged from the apparatus body 151 to complete the copying operation of the copying machine $M_3$ is similar to that described with respect to the copying machine $M_1$ of the fourth embodiment and therefore need not be described.

Further, when the copying machine $M_3$ is to be preserved at some other location upon completion of the copying operation, the handle portion 152*a* of the original pressing plate 152 is bent downwardly and the engaging piece 156 of the handle portion 152*a* fits into the engaging hole 157 of the apparatus body 151 and further comes into engagement with the engaging portion 159, whereby the handle portion 152*a* is fixed to the apparatus body 151. When the engaging piece 156 of the handle portion 152*a* comes into engagement with the engaging portion 159 of the apparatus body 151, the fore end of the engaging piece 156 comes into contact with the switch 160 and the change in the position of the handle portion 152*a* is detected by the switch 160. Thereupon, the signal from the switch 160 is transmitted to the control unit 161, which thus renders the copying machine $M_3$ inoperative. Even if a copy button is depressed by mistake when the copying machine $M_3$ is being carried or preserved, the copying operation will never be started as long as the handle portion 152*a* is fixed to the apparatus body 151, and thus, the original carriage, etc. will not move to damage the apparatus.

Also, when the copying machine $M_3$ is placed in its posture during the normal copying operation and the handle portion 152*a* of the original pressing plate 152 is released from its fixing to the apparatus body 151 and returned so as to be positioned above, the return of the position of the handle portion 152*a* is detected by the switch 160 and the copying machine $M_3$ is released from its inoperative condition.

We claim:

1. An image forming apparatus comprising:

conveying means for conveying sheet materials;

image forming means for forming images on the sheet materials conveyed by said conveying means;

posture detecting means for detecting the posture of the body of the apparatus and wherein said posture detecting means serves as sheet material detecting means for detecting the presence of the sheet material at a predetermined position in said conveying means;

control means for inhibiting the image forming operation by said image forming means when it is detected by said posture detecting means that the apparatus body is in a carried state or an erect state and wherein said control means inhibits the image forming operation by said image forming means after said posture detecting means has detected that the apparatus body is in its carried state or its erect state, and measuring means for counting a predetermined time period after it has detected that the apparatus body is in either the carried state or the erect state, said controlling means inhibiting the image formation by said image forming means at the point when said measuring means counts the predetermined time period.

2. An image forming apparatus according to claim 1, wherein said posture detecting means is operated by gravity.

3. An image forming apparatus according to claim 1, wherein said control means also serves as jam control means for inhibiting the image forming operation by said image forming means when the sheet material operates said posture detecting means greater than a predetermined time.

4. An image forming apparatus according to claim 1, further comprising switch means for generating an image forming operation starting signal and wherein said control means inhibits the image forming operation by said image forming means even if said switch means is brought into an ON state when said posture detecting means detects that the apparatus body is in its carried state or its erect state.

5. An image forming apparatus according to claim 1, wherein said posture detecting means has a pivotable lever member and a sensor for detecting the position of said lever member.

6. An image forming apparatus comprising:

conveying means for conveying sheet materials;

image forming means for forming images on the sheet materials conveyed by said conveying means;

posture detecting means for detecting the posture of the body of the apparatus wherein said posture detecting means is operated by gravity; and a reciprocally movable original carriage wherein said posture detecting means serves as original carriage movement blocking means for blocking the movement of said original carriage;

control means for inhibiting the image forming operation by said image forming means when said posture detecting means detects that the apparatus body is in its carried state or its erect state.

7. An image forming apparatus according to claim 6, further comprising switch means for generating an image forming operation starting signal and wherein said control means inhibits the image forming operation by said image forming means even if said switch means is brought into an ON state when said posture detecting means detects that the apparatus body is in its carried state or its erect state.

8. An image forming apparatus according to claim 6, wherein said posture detecting means has a pivotable lever member and a sensor for detecting the position of said lever member.

9. An image forming apparatus according to claim 6, wherein said original carriage movement blocking means has a ratchet mechanism.

10. An image forming apparatus according to claim 7, wherein when said posture detecting means detects that the apparatus body is in neither the carried state nor the erected state after said control means has inhibited the image forming operation by said image forming means, said control means releases the inhibition of the image forming operation by said image forming means.

11. An image forming apparatus according to claim 1, wherein the erected state of the apparatus body corresponds to a state where the apparatus is positioned with a surface thereof, which forms a side surface when said apparatus is in a normal copying state, being directed downwardly.

12. An image forming apparatus according to claim 1, further comprising a grip used for carrying the image forming apparatus.

13. An image forming apparatus according to claim 12, wherein the carried state corresponds to a state where the apparatus body is suspended from said grip.

14. An image forming apparatus according to claim 1, further comprising means for mounting an original thereon, said original mounting means being moved relative to the apparatus body when the image forming operation is performed.

15. An image forming apparatus according to claim 6, wherein when said posture detecting means detects that the apparatus body is in either the carried state or the erected state after said control means has inhibited the image forming operation by said image forming means, said control means releases the inhibition of the image forming operation by said image forming means.

16. An image forming apparatus according to claim 6, wherein the erected state of the apparatus body corresponds to a state where the apparatus is positioned with a surface thereof, which forms a side surface when said apparatus is in a normal copying state, being directed downwardly.

17. An image forming apparatus according to claim 6, wherein further comprising a grip used for carrying the image forming apparatus.

18. An image forming apparatus according to claim 17, wherein the carried state corresponds to a state where the apparatus body is suspended from said grip.

* * * * *

UNITED STATES PATENT AND TRADEMARK OFFICE

CERTIFICATE OF CORRECTION

PATENT NO. : 4,910,551

DATED : March 20, 1990

INVENTOR(S) : Shigeyoshi ONODA, ET AL.

It is certified that error appears in the above-identified patent and that said Letters Patent is hereby corrected as shown below:

COLUMN 1:

Line 51, "intends" should read --tends--; and

Line 55, "therefore" should read --therefor--.

COLUMN 4:

Line 16, "10 and 10" should read --10--;

Line 19, "space When" should read --space. When--;

Line 31, "chine M" should read --chine M,--;

Line 35, "handle 30 in" should read --handle 30 is in--;

Line 57, "and 45" should be deleted; and

Line 60, "45 and 45" should read --45--.

UNITED STATES PATENT AND TRADEMARK OFFICE

CERTIFICATE OF CORRECTION

PATENT NO. : 4,910,551

DATED : March 20, 1990

INVENTOR(S) : Shigeyoshi ONODA, ET AL.

It is certified that error appears in the above-identified patent and that said Letters Patent is hereby corrected as shown below:

COLUMN 5:

Line 42, "protrude" should read --protrudes--.

COLUMN 7:

Line 61, "legs 10 and 10" should read --legs 10--.

COLUMN 9:

Line 54, "long" should read --upright--.

COLUMN 13:

Line 11, "state," should read --state;--;

Line 13, "has detected" should read --has been detected--; and

UNITED STATES PATENT AND TRADEMARK OFFICE

CERTIFICATE OF CORRECTION

PATENT NO. : 4,910,551

DATED : March 20, 1990

INVENTOR(S) : Shigeyoshi ONODA, ET AL.

It is certified that error appears in the above-identified patent and that said Letters Patent is hereby corrected as shown below:

COLUMN 13 (Continued):

Line 15, "controlling means" should read --control means--.

COLUMN 14:

Line 13, "claim 7," should read --claim 1,--;

Line 39, change "either" to --neither--; and "or" to --nor--; and

Line 52, "wherein" should be deleted.

Signed and Sealed this

Twenty-third Day of June, 1992

*Attest:*

DOUGLAS B. COMER

*Attesting Officer*

*Acting Commissioner of Patents and Trademarks*